United States Patent [19]

Saijo et al.

[11] Patent Number: 4,540,233

[45] Date of Patent: Sep. 10, 1985

[54] FEMALE ELECTRICAL TERMINAL HAVING IMPROVED CONTACTOR BLOCK STRUCTURE

[75] Inventors: Eiji Saijo; Shigekazu Wakata, both of Yokkaichi, Japan

[73] Assignee: Tokai Electric Wire Company Limited, Yokkaichi, Japan

[21] Appl. No.: 645,612

[22] Filed: Aug. 29, 1984

[30] Foreign Application Priority Data

Oct. 1, 1983 [JP] Japan ..... 58-152662[U]
Oct. 7, 1983 [JP] Japan ..... 58-156717[U]

[51] Int. Cl.[3] ..... H01R 13/12
[52] U.S. Cl. ..... 339/258 R
[58] Field of Search ..... 339/258 R, 258 P, 259

[56] References Cited

U.S. PATENT DOCUMENTS 1,194,122 8/1916 Ball ..... 339/258 R
3,836,947 9/1974 Yeager ..... 339/259 R
4,068,917 1/1978 Leidler ..... 339/258 R

*Primary Examiner*—Joseph H. McGlynn
*Attorney, Agent, or Firm*—Harness, Dickey & Pierce

[57] ABSTRACT

A single sheet material is punched and bent to form an improved female terminal comprising a contactor block including a resilient contact piece a bottom plate and an upper plate having an extension bent toward the bottom plate to form a protective guide tag at an end opening of the contactor block through which a male terminal is inserted into the contactor block. The protective guide tag corrects insertion posture of the male terminal, thereby preventing degradation in resiliency of the resilient contact piece of the contactor block and improving electrical connection between the male terminal and the female terminal.

4 Claims, 15 Drawing Figures

FEMALE ELECTRICAL TERMINAL HAVING IMPROVED CONTACTOR BLOCK STRUCTURE

The present invention relates to improvements of female electrical terminal and more particularly to an improvement of a contactor block of a female electrical terminal hereinafter simply referred to as feamle terminal to which a male terminal makes resilient contact.

Conventionally, as shown in FIG. 1, a female terminal 1 is fabricated by punching a single sheet material to have a box-like contactor block 5 comprising an upper plate 2, a bottom plate 3, and side plates 4,4. The single sheet material is also worked to form a resilient contact piece 6 in the form of a thin leaf spring between the upper plate 2 and the bottom plate 3. A tab contactor 8 of a male terminal to be in contact with the contactor block of the female terminal 1 is received in a front opening 7 of the contactor block 5 so as to be clamped resiliently between the resilient contact piece 6 and the bottom plate 3. Specifically, the resilient contact piece 6 of the prior art female connector takes the form of a thin leaf spring cantilever which is prepared by bending inwardly either a righthand side or a lefthand side of the box-like contactor block 5 formed of the single sheet material. With the prior art female connector, in the event that the tab contactor 8 of the male connector to be inserted in parallel with the bottom plate 3 of the female terminal 1 is obliquely inserted for inadvertency, the tip of the tab contactor 8 collides against the resilient contact piece 6 to cause plastic deformation in the resilient contact piece 6 or damage the same, thus impairing electrical connection characteristics of the contactor block 5.

Recent trend of reducing the size of the connector aggravates the above disadvantage since the spring constant of the contactor block of the female terminal is inevitably increased and as a result, the contactor block becomes highly rigid to have a reduced flexure for the same load as before.

Another prior art terminal of this type is disclosed in U.S. Pat. No. 3,836,947.

An object of this invention is to obviate the disadvantage of the prior art female terminal and to provide an improved female terminal which can prohibit oblique insertion of a male terminal into the female terminal to prevent a resilient contact piece of a contactor block of the female terminal from being deteriorated, thereby ensuring perfect electrical connection between the male connector and the female terminal.

Another object of this invention is to provide an improved female terminal which can have high durability even when reduced in size.

Still another object of this invention is to provide an improved female terminal which can reduce the spring constant of a contactor block of the female terminal to be in contact with a male terminal.

Still another object of this invention is to provide an improved female terminal which can uniform contacting load between the female terminal and the male terminal.

The present invention will be apparent from the following detailed description taken in conjunction with the accompanying drawings, in which.

Figure 1:
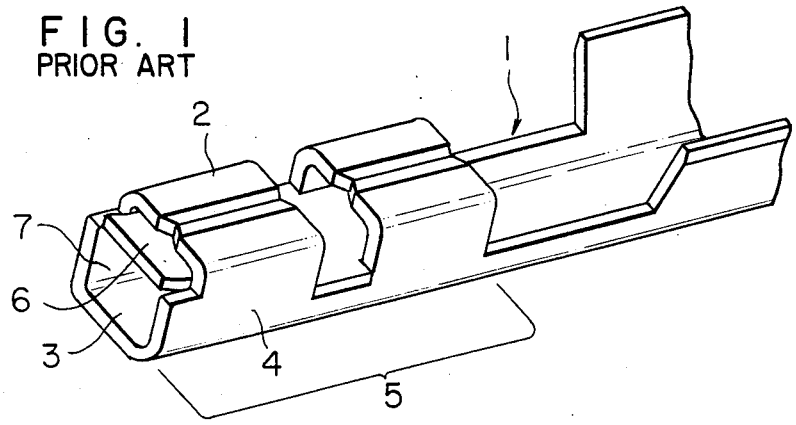
FIG. 1 PRIOR ART
FIG. 1 is a perspective view showing the construction of a prior art female terminal.
Figure 2:
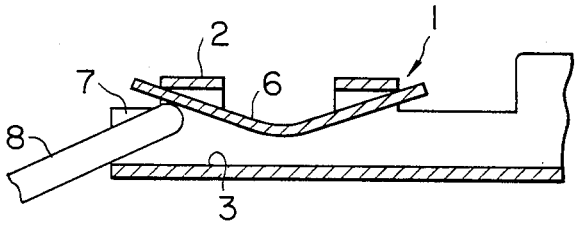
FIG. 2 PRIOR ART
FIG. 2 is a sectional view useful to show the prior art female terminal in use.
Figure 3:
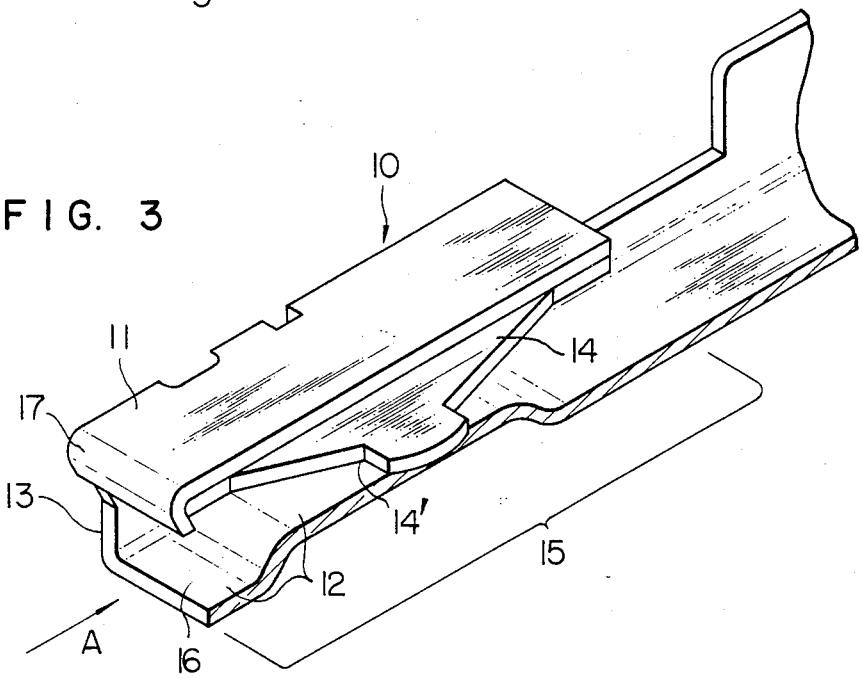
FIG. 3 is a perspective view, partly exploded, of a first embodiment of a female terminal according to the invention.
Figure 4:
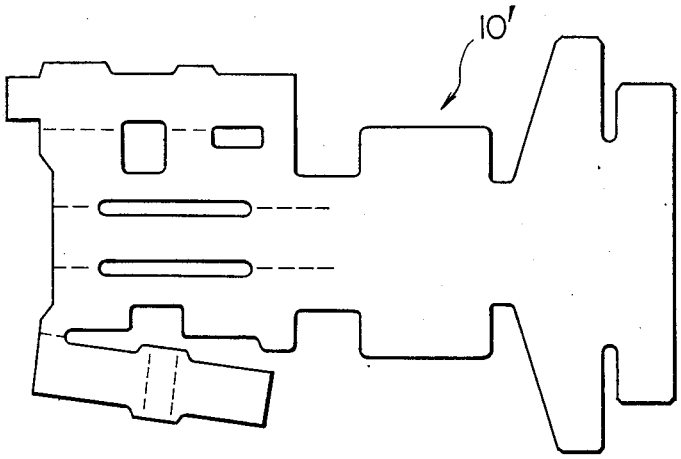
FIG. 4 shows a development of a single sheet material used for the first embodiment.
Figure 5:
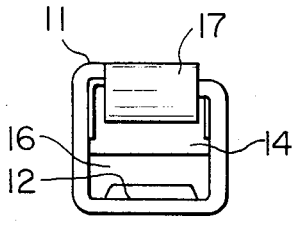
FIG. 5 is a side view of the female terminal as seen in the direction of arrow A in FIG. 3.
Figure 6:
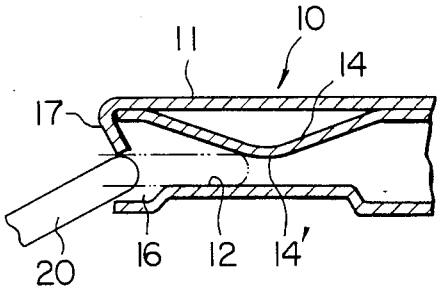
FIG. 6 is a sectional view useful to show the female terminal of the first embodiment in use.

Referring now to FIGS. 3 to 6, a first embodiment of a female terminal according to the invention will be described. In particular, FIG. 3 illustrates, in perspective form, the female terminal generally designated at reference numeral 10, and FIG. 4 illustrates a single sheet material 10' contoured by punching for the formation of the female terminal 10. The single sheet material 10' is bent to form the female terminal 10 having a contactor block 15 comprising an upper plate 11, a bottom plate 12, side plates 13,13 and a resilient contact piece 14. As best seen from FIG. 5, the contactor block 15 having the upper plate 11, bottom plate 12 and side plates 13,13 takes the form of a substantially rectangular channel. The single sheet material 10' has a portion as an extension of one side plate 13, and the extension is bent inwardly to provide the resilient contact piece 14 acting as a cantilever in the form of a thin leaf spring. The resilient contact piece 14 extends over substantially the entire length of the contactor block 15. This contactor block 15 has a front opening 16 through which a tab contactor 20 of a male terminal is inserted so that the tab contactor 20 is resiliently clamped between the resilient contact piece 14 and the bottom plate 12. A slight extension of the upper plate 11 is bent toward the bottom plate 12 to form a protective guide tag which suspends above the front opening 16.

The protective guide tag 17 intends to guide the tab contactor 20 of the male connector to be inserted into the contactor block 15 and to protect the resilient contact piece 14 from damage. To assist in insertion of the top contactor 20, the lower end of the protective guide tag 17 is slightly inclined so as to be directed toward the interior of the contactor block 15. In addition, in order to enhance the guidance, the protective guide tag 17 extends nearly until a lowermost level 14' which the resilient contact piece 14 bears when the make terminal is inserted.

According to the female connector with the resilient contact piece of this embodiment, when the tab contactor 20 of the male terminal to be inserted into the opening 16 of the contactor block 15 is obliquely pushed into for inadventency with respect to the upper plate 11 and the bottom plate 12, the tip of the tab contactor 20 collides against the protective guide tag 17 so that the inserting posture of the tab contactor 20 is so corrected as to be substantially parallel to the upper plate 11 and the bottom plate 12 and the tab contactor 20 can be correctly clamped between the resilient contact piece 14 and the bottom plate 12.

Accordingly, the spring constant of the resilient contact piece 14 made of a soft thin sheet can be increased without causing plastic deformation in the contact piece and damage to both the resilient contact piece and male terminal, giving rise to good electrical connection characteristics of the contactor block 15.

Figure 7:
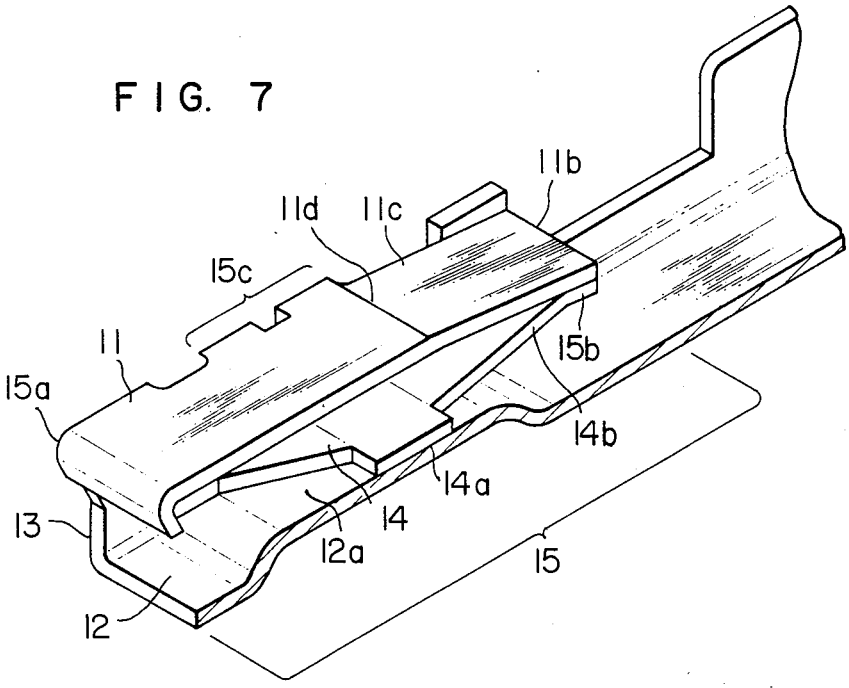
FIG. 7 is a perspective view, partly exploded, of a second embodiment of the female terminal according to the invention.
Figure 8:
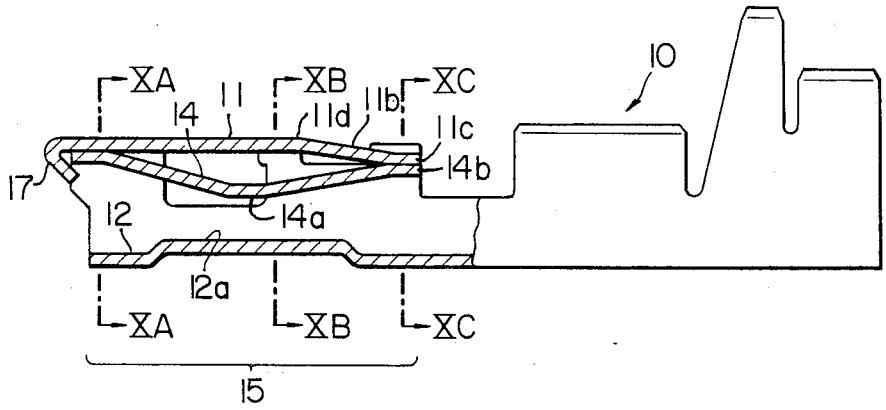
FIG. 8 is a longitudinal sectional view of the second embodiment.
Figure 9:
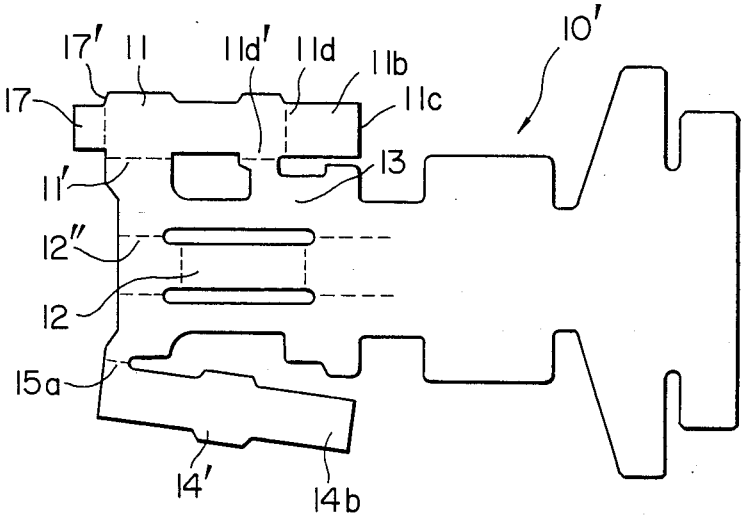
FIG. 9 shows a development of a single sheet material used for the second embodiment.

FIGS. 7 to 12 illustrate a second embodiment of this invention, with FIG. 7 showing, in perspective form, a female connector according to the second embodiment and FIG. 8 being a partially longitudinally sectional view of the female terminal. A single sheet material 10' shown in FIG. 9 is bent to form a female terminal 10, as in the first embodiment. A spring contact piece 14 of a thin leaf spring taking the form of a cantilever prepared by bending the single sheet material extends longitudinally of a spring contactor block 15 over the entire length thereof between an upper plate 11 and a bottom plate 12 of the contactor block 15 of the female terminal 10. The spring contact piece 14 has a stationary end 15*a* at the front end of the spring contactor block 15 and a free end 14*b* at the rear end of the contactor block 15. An intermediate portion of the contact piece 14 is arcuated with its convex surface opposed to the bottom plate 12. An apex 14*a* of the resilient contact piece 14, existing substantially in the middle of the arcuate curve in the longitudinal direction of the contact piece, is flattened to be parallel with the bottom plate 12. Reference numeral 17 designates a protective guide tag.

A substantially intermediate portion of the bottom plate 12 is stepped or raised to form a raised portion 12*a*. The male connector is inserted and resiliently clamped between the apex 14*a* of the resilient contact piece 14 and the raised portion 12*a* of the bottom plate 12.

Incidentally, the single sheet material is also bent to form the upper plate 11 having a protective guide tag 17 which acts as a front end cover of the contactor block 15 and an intermediate portion 15*c* which acts as an upper cover of the contactor block 15. A spring portion 11*b* of the upper plate 11 provides a cantilever having one stationary end at a bending point 11*d* and the other free end 11*c* making contact to the rear free end 14*b* of the resilient contact piece 14. More particularly, the rear spring portion 11*b* of the upper plate 11 is slightly bent at the stationary end so that the free end 11*c* approaches to the bottom plate 12 and overlaps the free end 14*b* of the spring cotnact piece 14.

The single sheet material for the second embodiment as shown in developed form in FIG. 9 is punched to provide the bottom plate 12, spring contact piece 14, upper plate 11 together with its rear spring portion 11*b* which are mutually interconnected and bent through 90° along bending lines, illustrated at dotted lines, to form the contactor block having a cross-section of a rectangular channel.

Figure 10A:
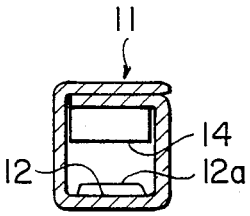
FIG. 10A is a sectional view taken on line A—A in FIG. 8.
Figure 10B:
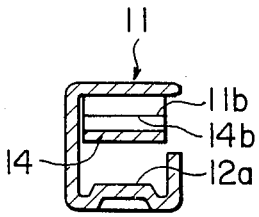
FIG. 10B is a sectional view taken on line B—B in FIG. 8.
Figure 10C:
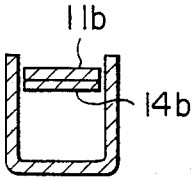
FIG. 10C is a sectional view on line C—C in FIG. 8.

The spring contactor block 15 of the female terminal 10 shown in FIG. 8 is sectioned on line A—A, line B—B and line C—C as shown in FIGS. 10A, 10B and 10C, respectively.

Especially, the single sheet material 10' for the formation of the contactor block 15 of the second embodiment has the upper plate 1 integral with the bottom plate 12 through bending lines 11' and 12''. The bottom plate 12 is bent along middle parallel bending lines 12'' to be formed into a channel having the side plates 13,13. The upper plate 11 is bent along the bending line 11' and is further bent along a bending line 11*d'* to provide the stationary end 11*d* of the spring portion 11*b*. One side plate 13, a lower side plate remote from the upper plate in FIG. 9, has a front end integral with the spring contact piece 14 through a bending line 15*a'*. The spring contact piece 14 is bent at the bending line 15*a'* to provide the arcuately curved contact piece betwen the bottom plate 12 and the upper plate 11.

The protective guide tag 17 is prepared by bending the single sheet material 10' along a bending line 17'.

In the thus prepared contactor block 15, the arcuately curved spring contact piece 14 defines, on the back side, a spacing for flexure so that the spring portion 11*b* of the upper plate 11 and the contact piece 14 freely undergo flexion in the vertical direction.

Figure 11:
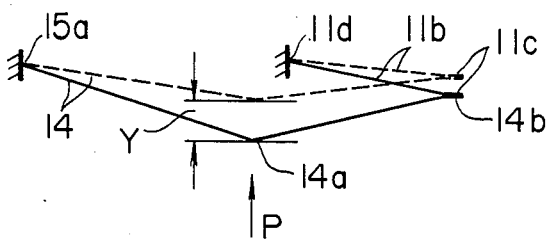
FIG. 11 is a diagrammatic representation useful in explaining the operation of the second embodiment.
Figure 12:
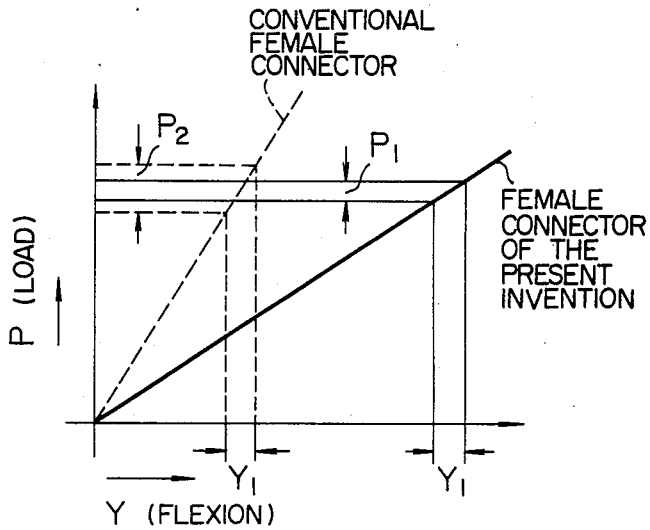
FIG. 12 is a graph showing comparative spring characteristics between the second embodiment and the prior art female terminal.

The spring contactor block operates as follows. Referring to FIG. 11, a composite structure is formed wherein the upper spring portion 11*b* and the lower thin spring contact piece 14 taking the form of cantilevers having different stationary ends 11*d* and 15*a* overlap together at the free ends 11*c* and 14*b*. Accordingly, under the application of a load P, the composite structure is deflected by a flexion Y which equals a resultant flexion of the spring contact piece 14 and the spring portion 11*b*. Therefore, when compared with the conventional contactor block using a single leaf spring having opposite ends which are stationary, the contactor block 15 according to the second embodiment of this invention can be reduced considerably in spring constant and consequently, increased in resiliency. By using sheet materials of the same properties and the same thickness, resilient contactor blocks or female terminal are fabricated of which one is of the conventional type and the other is of the type according to this embodiment of the invention to obtain comparative spring characteristics as graphically shown in FIG. 12. As will be seen from FIG. 12, the spring constant of the female terminal of this embodiment is reduced to about half the spring constant of the conventional female terminal, with the result that the female terminal of this embodiment is increased in resiliency and for a flexion change $Y_1$, has a load change $P_1$ which is about half a load change $P_2$ of the conventional female terminal.

Figure 13:
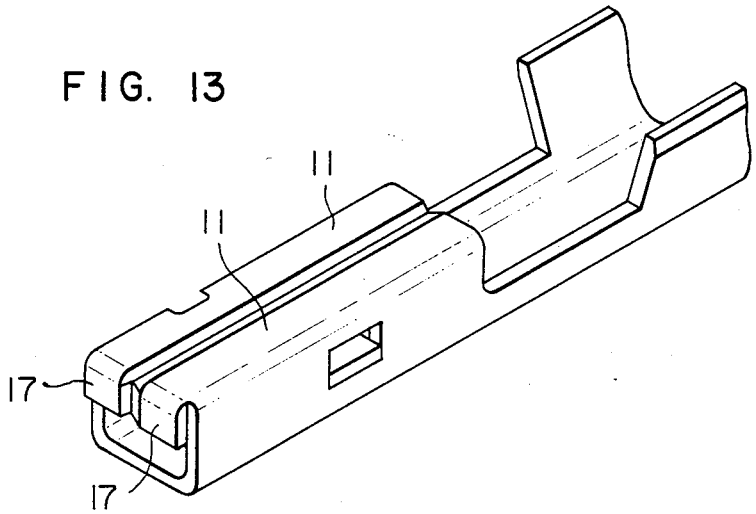
FIG. 13 is a perspective view showing another embodiment of the invention.

The protective guide tag 17 may be modified as shown in FIG. 13. More particularly, the opposed side plates are bent to form opposed upper plates 11,11, and front extensions of the respective upper plates are bent downwardly to provide opposed protective guide tags 17,17 which are separated from each other through a central gap.

As described above, the female terminal with the spring contactor block according to the present invention can minimize the change of contact load imparted on the male terminal and the spring contactor block 15, which change is correlated to the change of flexion of the spring contactor block 15, even when the female terminal and the male terminal have irregularity in dimention or measure which occurs inevitably in manufacture of these terminals, and can greatly stabilize the contact load, thereby providing sufficient contact load for electrical connection and consequent good and stable connection between the female and male terminals.

In addition, the female terminal of this invention is expected to be further improved in miniaturization.

In sum, the present invention can advantageously inprove the female terminal with the spring contactor block and contribute to improvement and stabilization of electrical performance of the female terminal.

We claim:

1. A female terminal fabricated by bending a single sheet material comprising:

a contactor block having an end opening through which a male terminal is inserted into said contactor block so as to make contact therewith, said contactor block including an upper plate, a bottom plate, and side plates;

a resilient contact piece disposed between said upper plate and bottom plate; and a protective guide tag formed of an extension of said upper plate which is bent, at said end opening of said contactor block, toward said bottom plate.

2. A female terminal according to claim 1, wherein said resilient contact piece takes the form of a cantilever having a stationary end at said end opening of said contactor block.

3. A female terminal according to claim 2, wherein said resilient contact piece in the form of the cantilever is arcuately curved to oppose said bottom plate.

4. A female terminal according to claim 2, wherein said upper plate has a rear spring portion having a free end which overlaps a free end of said resilient contact piece in the form of the cantilever.

* * * * *